US010506327B2

(12) United States Patent
Boesen

(10) Patent No.: US 10,506,327 B2
(45) Date of Patent: Dec. 10, 2019

(54) AMBIENT ENVIRONMENTAL SOUND FIELD MANIPULATION BASED ON USER DEFINED VOICE AND AUDIO RECOGNITION PATTERN ANALYSIS SYSTEM AND METHOD

(71) Applicant: BRAGI GmbH, München (DE)

(72) Inventor: Peter Vincent Boesen, München (DE)

(73) Assignee: BRAGI GmbH, München (DE)

( * ) Notice: Subject to any disclaimer, the term of this patent is extended or adjusted under 35 U.S.C. 154(b) by 0 days.

(21) Appl. No.: 15/847,287

(22) Filed: Dec. 19, 2017

(65) Prior Publication Data

US 2018/0184195 A1 Jun. 28, 2018

Related U.S. Application Data

(60) Provisional application No. 62/439,371, filed on Dec. 27, 2016.

(51) Int. Cl.
*H04R 1/10* (2006.01)
*H04R 29/00* (2006.01)
(Continued)

(52) U.S. Cl.
CPC ..... *H04R 1/1083* (2013.01); *H04R 1/1016* (2013.01); *H04R 1/1041* (2013.01);
(Continued)

(58) Field of Classification Search
CPC . H04R 1/1083; H04R 1/1016; H04R 2225/41
See application file for complete search history.

(56) References Cited

U.S. PATENT DOCUMENTS 2,325,590 A 8/1943 Carlisle et al.
2,430,229 A 11/1947 Kelsey
(Continued)

FOREIGN PATENT DOCUMENTS

CN 204244472 U 4/2015
CN 104683519 A 6/2015
(Continued)

OTHER PUBLICATIONS

The Dash—A Word From Our Software, Mechanical and Acoustics Team + An Update (Mar. 11, 2014).
(Continued)

*Primary Examiner* — David L Ton
(74) *Attorney, Agent, or Firm* — Goodhue, Coleman & Owens, P.C.

(57) ABSTRACT

In embodiments of the present invention, a method of modifying ambient sound received by an earpiece in accordance with an environmental characterization may have one or more of the following steps: (a) receiving the ambient sound at a microphone operably coupled to the earpiece, (b) determining, via a processor operably coupled to the microphone, the environmental characterization based on the ambient sound, (c) modifying, via the processor, the ambient sound in accordance with a plurality of parameters associated with the environmental characterization to create a modified ambient sound, (d) communicating, via a speaker operably coupled to the earpiece, the modified ambient sound, (e) receiving the ambient sound at the second microphone, (f) determining, via the processor, a location of the ambient sound from a temporal differential and an intensity differential between the reception of the ambient sound at the microphone and the reception of the ambient sound at the second microphone, and (g) determining, via the processor, a location of the ambient sound from a temporal differential
(Continued)

and an intensity differential between the reception of the ambient sound at the microphone of the earpiece and the reception of the ambient sound at the second microphone of the second earpiece.

15 Claims, 6 Drawing Sheets

(51) Int. Cl.
*H04R 1/40* (2006.01)
*H04R 1/46* (2006.01)
*H04R 25/00* (2006.01)

(52) U.S. Cl.
CPC ..... *H04R 29/001* (2013.01); *H04R 1/406* (2013.01); *H04R 1/46* (2013.01); *H04R 25/606* (2013.01); *H04R 29/008* (2013.01); *H04R 2225/41* (2013.01); *H04R 2420/07* (2013.01); *H04R 2460/07* (2013.01); *H04R 2460/13* (2013.01)

(56) References Cited

U.S. PATENT DOCUMENTS 3,047,089 A 7/1962 Zwislocki
D208,784 S 10/1967 Sanzone
3,586,794 A 6/1971 Michaelis
3,934,100 A 1/1976 Harada
3,983,336 A 9/1976 Malek et al.
4,069,400 A 1/1978 Johanson et al.
4,150,262 A 4/1979 Ono
4,334,315 A 6/1982 Ono et al.
D266,271 S 9/1982 Johanson et al.
4,375,016 A 2/1983 Harada
4,588,867 A 5/1986 Konomi
4,617,429 A 10/1986 Bellafiore
4,654,883 A 3/1987 Iwata
4,682,180 A 7/1987 Gans
4,791,673 A 12/1988 Schreiber
4,852,177 A 7/1989 Ambrose
4,865,044 A 9/1989 Wallace et al.
4,984,277 A 1/1991 Bisgaard et al.
5,008,943 A 4/1991 Arndt et al.
5,185,802 A 2/1993 Stanton
5,191,602 A 3/1993 Regen et al.
5,201,007 A 4/1993 Ward et al.
5,201,008 A 4/1993 Arndt et al.
D340,286 S 10/1993 Seo
5,280,524 A 1/1994 Norris
5,295,193 A 3/1994 Ono
5,298,692 A 3/1994 Ikeda et al.
5,343,532 A 8/1994 Shugart
5,347,584 A 9/1994 Narisawa
5,363,444 A 11/1994 Norris
D367,113 S 2/1996 Weeks
5,497,339 A 3/1996 Bernard
5,606,621 A 2/1997 Reiter et al.
5,613,222 A 3/1997 Guenther
5,654,530 A 8/1997 Sauer et al.
5,692,059 A 11/1997 Kruger
5,721,783 A 2/1998 Anderson
5,748,743 A 5/1998 Weeks
5,749,072 A 5/1998 Mazurkiewicz et al.
5,771,438 A 6/1998 Palermo et al.
D397,796 S 9/1998 Yabe et al.
5,802,167 A 9/1998 Hong
D410,008 S 5/1999 Almqvist
5,929,774 A 7/1999 Charlton
5,933,506 A 8/1999 Aoki et al.
5,949,896 A 9/1999 Nageno et al.
5,987,146 A 11/1999 Pluvinage et al.
6,021,207 A 2/2000 Puthuff et al.
6,054,989 A 4/2000 Robertson et al.
6,081,724 A 6/2000 Wilson
6,084,526 A 7/2000 Blotky et al.
6,094,492 A 7/2000 Boesen
6,111,569 A 8/2000 Brusky et al.
6,112,103 A 8/2000 Puthuff
6,157,727 A 12/2000 Rueda
6,167,039 A 12/2000 Karlsson et al.
6,181,801 B1 1/2001 Puthuff et al.
6,208,372 B1 3/2001 Barraclough
6,230,029 B1 5/2001 Yegiazaryan et al.
6,275,789 B1 8/2001 Moser et al.
6,339,754 B1 1/2002 Flanagan et al.
D455,835 S 4/2002 Anderson et al.
6,408,081 B1 6/2002 Boesen
6,424,820 B1 7/2002 Burdick et al.
D464,039 S 10/2002 Boesen
6,470,893 B1 10/2002 Boesen
D468,299 S 1/2003 Boesen
D468,300 S 1/2003 Boesen
6,542,721 B2 4/2003 Boesen
6,560,468 B1 5/2003 Boesen
6,563,301 B2 5/2003 Gventer
6,654,721 B2 11/2003 Handelman
6,664,713 B2 12/2003 Boesen
6,690,807 B1 2/2004 Meyer
6,694,180 B1 2/2004 Boesen
6,718,043 B1 4/2004 Boesen
6,738,485 B1 5/2004 Boesen
6,748,095 B1 6/2004 Goss
6,754,358 B1 6/2004 Boesen et al.
6,784,873 B1 8/2004 Boesen et al.
6,823,195 B1 11/2004 Boesen
6,852,084 B1 2/2005 Boesen
6,879,698 B2 4/2005 Boesen
6,892,082 B2 5/2005 Boesen
6,920,229 B2 7/2005 Boesen
6,952,483 B2 10/2005 Boesen et al.
6,987,986 B2 1/2006 Boesen
7,010,137 B1 3/2006 Leedom et al.
7,113,611 B2 9/2006 Leedom et al.
D532,520 S 11/2006 Kampmeier et al.
7,136,282 B1 11/2006 Rebeske
7,203,331 B2 4/2007 Boesen
7,209,569 B2 4/2007 Boesen
7,215,790 B2 5/2007 Boesen et al.
D549,222 S 8/2007 Huang
D554,756 S 11/2007 Sjursen et al.
7,403,629 B1 7/2008 Aceti et al.
D579,006 S 10/2008 Kim et al.
7,463,902 B2 12/2008 Boesen
7,508,411 B2 3/2009 Boesen
D601,134 S 9/2009 Elabidi et al.
7,825,626 B2 11/2010 Kozisek
7,965,855 B1 6/2011 Ham
7,979,035 B2 7/2011 Griffin et al.
7,983,628 B2 7/2011 Boesen
D647,491 S 10/2011 Chen et al.
8,095,188 B2 1/2012 Shi
8,108,143 B1 1/2012 Tester
8,140,357 B1 3/2012 Boesen
D666,581 S 9/2012 Perez
8,300,864 B2 10/2012 Müllenborn et al.
8,406,448 B2 3/2013 Lin et al.
8,430,817 B1 4/2013 Al-Ali et al.
8,436,780 B2 5/2013 Schantz et al.
D687,021 S 7/2013 Yuen
8,679,012 B1 3/2014 Kayyali
8,719,877 B2 5/2014 VonDoenhoff et al.
8,774,434 B2 7/2014 Zhao et al.
8,831,266 B1 9/2014 Huang
8,891,800 B1 11/2014 Shaffer
8,994,498 B2 3/2015 Agrafioti et al.
D728,107 S 4/2015 Martin et al.
9,013,145 B2 4/2015 Castillo et al.
9,037,125 B1 5/2015 Kadous
D733,103 S 6/2015 Jeong et al.
9,081,944 B2 7/2015 Camacho et al.
9,510,159 B1 11/2016 Cuddihy et al.
D773,439 S 12/2016 Walker

(56) References Cited

U.S. PATENT DOCUMENTS

D775,158 S 12/2016 Dong et al.
D777,710 S 1/2017 Palmborg et al.
9,544,689 B2 1/2017 Fisher et al.
D788,079 S 5/2017 Son et al.
2001/0005197 A1 6/2001 Mishra et al.
2001/0027121 A1 10/2001 Boesen
2001/0043707 A1 11/2001 Leedom
2001/0056350 A1 12/2001 Calderone et al.
2002/0002413 A1 1/2002 Tokue
2002/0007510 A1 1/2002 Mann
2002/0010590 A1 1/2002 Lee
2002/0030637 A1 3/2002 Mann
2002/0046035 A1 4/2002 Kitahara et al.
2002/0057810 A1 5/2002 Boesen
2002/0076073 A1 6/2002 Taenzer et al.
2002/0118852 A1 8/2002 Boesen
2003/0002705 A1 1/2003 Boesen
2003/0065504 A1 4/2003 Kraemer et al.
2003/0100331 A1 5/2003 Dress et al.
2003/0104806 A1 6/2003 Ruef et al.
2003/0115068 A1 6/2003 Boesen
2003/0125096 A1 7/2003 Boesen
2003/0218064 A1 11/2003 Conner et al.
2004/0070564 A1 4/2004 Dawson et al.
2004/0160511 A1 8/2004 Boesen
2005/0017842 A1 1/2005 Dematteo
2005/0043056 A1 2/2005 Boesen
2005/0094839 A1 5/2005 Gwee
2005/0125320 A1 6/2005 Boesen
2005/0148883 A1 7/2005 Boesen
2005/0165663 A1 7/2005 Razumov
2005/0196009 A1 9/2005 Boesen
2005/0251455 A1 11/2005 Boesen
2005/0266876 A1 12/2005 Boesen
2006/0029246 A1 2/2006 Boesen
2006/0073787 A1 4/2006 Lair et al.
2006/0074671 A1 4/2006 Farmaner et al.
2006/0074808 A1 4/2006 Boesen
2006/0166715 A1 7/2006 Engelen et al.
2006/0166716 A1 7/2006 Seshadri et al.
2006/0220915 A1 10/2006 Bauer
2006/0258412 A1 11/2006 Liu
2008/0076972 A1 3/2008 Dorogusker et al.
2008/0090622 A1 4/2008 Kim et al.
2008/0146890 A1 6/2008 LeBoeuf et al.
2008/0187163 A1 8/2008 Goldstein et al.
2008/0253583 A1 10/2008 Goldstein et al.
2008/0254780 A1 10/2008 Kuhl et al.
2008/0255430 A1 10/2008 Alexandersson et al.
2008/0298606 A1 12/2008 Johnson et al.
2009/0003620 A1 1/2009 McKillop et al.
2009/0008275 A1 1/2009 Ferrari et al.
2009/0017881 A1 1/2009 Madrigal
2009/0073070 A1 3/2009 Rofougaran
2009/0097689 A1 4/2009 Prest et al.
2009/0105548 A1 4/2009 Bart
2009/0154739 A1 6/2009 Zellner
2009/0191920 A1 7/2009 Regen et al.
2009/0245559 A1 10/2009 Boltyenkov et al.
2009/0261114 A1 10/2009 McGuire et al.
2009/0296968 A1 12/2009 Wu et al.
2010/0033313 A1 2/2010 Keady et al.
2010/0203831 A1 8/2010 Muth
2010/0210212 A1 8/2010 Sato
2010/0320961 A1 12/2010 Castillo et al.
2011/0140844 A1 6/2011 McGuire et al.
2011/0239497 A1 10/2011 McGuire et al.
2011/0286615 A1 11/2011 Olodort et al.
2012/0057740 A1 3/2012 Rosal
2012/0155670 A1 6/2012 Rutschman
2012/0309453 A1 12/2012 Maguire
2013/0106454 A1 5/2013 Liu et al.
2013/0316642 A1 11/2013 Newham
2013/0346168 A1 12/2013 Zhou et al.
2014/0004912 A1 1/2014 Rajakarunanayake
2014/0014697 A1 1/2014 Schmierer et al.
2014/0020089 A1 1/2014 Perini, II
2014/0072136 A1 3/2014 Tenenbaum et al.
2014/0079257 A1 3/2014 Ruwe et al.
2014/0106677 A1 4/2014 Altman
2014/0122116 A1 5/2014 Smythe
2014/0146973 A1 5/2014 Liu et al.
2014/0153768 A1 6/2014 Hagen et al.
2014/0163771 A1 6/2014 Demeniuk
2014/0185828 A1 7/2014 Helbling
2014/0219467 A1 8/2014 Kurtz
2014/0222462 A1 8/2014 Shakil et al.
2014/0235169 A1 8/2014 Parkinson et al.
2014/0270227 A1 9/2014 Swanson
2014/0270271 A1 9/2014 Dehe et al.
2014/0335908 A1 11/2014 Krisch et al.
2014/0348367 A1 11/2014 Vavrus et al.
2015/0028996 A1 1/2015 Agrafioti et al.
2015/0035643 A1 2/2015 Kursun
2015/0036835 A1 2/2015 Chen
2015/0110587 A1 4/2015 Hori
2015/0148989 A1 5/2015 Cooper et al.
2015/0172814 A1* 6/2015 Usher ..... H04R 3/005 381/92
2015/0181356 A1 6/2015 Krystek et al.
2015/0195641 A1* 7/2015 Di Censo ..... H04R 1/1083 381/71.6
2015/0245127 A1 8/2015 Shaffer
2015/0264472 A1 9/2015 Aase
2015/0264501 A1 9/2015 Hu et al.
2015/0358751 A1 12/2015 Deng et al.
2015/0359436 A1 12/2015 Shim et al.
2015/0373467 A1 12/2015 Gelter
2015/0373474 A1 12/2015 Kraft et al.
2016/0033280 A1 2/2016 Moore et al.
2016/0034249 A1 2/2016 Lee et al.
2016/0071526 A1 3/2016 Wingate et al.
2016/0072558 A1 3/2016 Hirsch et al.
2016/0073189 A1 3/2016 Lindén et al.
2016/0125892 A1 5/2016 Bowen et al.
2016/0162259 A1 6/2016 Zhao et al.
2016/0209691 A1 7/2016 Yang et al.
2016/0324478 A1 11/2016 Goldstein
2016/0353196 A1 12/2016 Baker et al.
2016/0360350 A1 12/2016 Watson et al.
2017/0059152 A1 3/2017 Hirsch et al.
2017/0060262 A1 3/2017 Hviid et al.
2017/0060269 A1 3/2017 Förstner et al.
2017/0061751 A1 3/2017 Loermann et al.
2017/0062913 A1 3/2017 Hirsch et al.
2017/0064426 A1 3/2017 Hviid
2017/0064428 A1 3/2017 Hirsch
2017/0064432 A1 3/2017 Hviid et al.
2017/0064437 A1 3/2017 Hviid et al.
2017/0078780 A1 3/2017 Qian et al.
2017/0078785 A1 3/2017 Qian et al.
2017/0108918 A1 4/2017 Boesen
2017/0109131 A1 4/2017 Boesen
2017/0110124 A1 4/2017 Boesen et al.
2017/0110899 A1 4/2017 Boesen
2017/0111723 A1 4/2017 Boesen
2017/0111725 A1 4/2017 Boesen et al.
2017/0111726 A1 4/2017 Martin et al.
2017/0111740 A1 4/2017 Hviid et al.
2017/0127168 A1 5/2017 Briggs et al.
2017/0131094 A1 5/2017 Kulik
2017/0142511 A1 5/2017 Dennis
2017/0146801 A1 5/2017 Stempora
2017/0151447 A1 6/2017 Boesen
2017/0151668 A1 6/2017 Boesen
2017/0151918 A1 6/2017 Boesen
2017/0151930 A1 6/2017 Boesen
2017/0151957 A1 6/2017 Boesen
2017/0151959 A1 6/2017 Boesen
2017/0153114 A1 6/2017 Boesen
2017/0153636 A1 6/2017 Boesen
2017/0154532 A1 6/2017 Boesen
2017/0155985 A1 6/2017 Boesen
2017/0155992 A1 6/2017 Perianu et al.

(56) References Cited

U.S. PATENT DOCUMENTS

| | | | |
|---|---|---|---|
| 2017/0155993 | A1 | 6/2017 | Boesen |
| 2017/0155997 | A1 | 6/2017 | Boesen |
| 2017/0155998 | A1 | 6/2017 | Boesen |
| 2017/0156000 | A1 | 6/2017 | Boesen |
| 2017/0178631 | A1 | 6/2017 | Boesen |
| 2017/0180842 | A1 | 6/2017 | Boesen |
| 2017/0180843 | A1 | 6/2017 | Perianu et al. |
| 2017/0180897 | A1 | 6/2017 | Perianu |
| 2017/0188127 | A1 | 6/2017 | Perianu et al. |
| 2017/0188132 | A1 | 6/2017 | Hirsch et al. |
| 2017/0193978 | A1 | 7/2017 | Goldman |
| 2017/0195829 | A1 | 7/2017 | Belverato et al. |
| 2017/0208393 | A1 | 7/2017 | Boesen |
| 2017/0214987 | A1 | 7/2017 | Boesen |
| 2017/0215016 | A1 | 7/2017 | Dohmen et al. |
| 2017/0230752 | A1 | 8/2017 | Dohmen et al. |
| 2017/0251933 | A1 | 9/2017 | Braun et al. |
| 2017/0257698 | A1 | 9/2017 | Boesen et al. |
| 2017/0263236 | A1 | 9/2017 | Boesen et al. |
| 2017/0273622 | A1 | 9/2017 | Boesen |
| 2017/0280257 | A1 | 9/2017 | Gordon et al. |
| 2017/0366233 | A1 | 12/2017 | Hviid et al. |
| 2018/0007994 | A1 | 1/2018 | Boesen et al. |
| 2018/0008194 | A1 | 1/2018 | Boesen |
| 2018/0008198 | A1 | 1/2018 | Kingscott |
| 2018/0009447 | A1 | 1/2018 | Boesen et al. |
| 2018/0011006 | A1 | 1/2018 | Kingscott |
| 2018/0011682 | A1 | 1/2018 | Milevski et al. |
| 2018/0011994 | A1 | 1/2018 | Boesen |
| 2018/0012228 | A1 | 1/2018 | Milevski et al. |
| 2018/0013195 | A1 | 1/2018 | Hviid et al. |
| 2018/0014102 | A1 | 1/2018 | Hirsch et al. |
| 2018/0014103 | A1 | 1/2018 | Martin et al. |
| 2018/0014104 | A1 | 1/2018 | Boesen et al. |
| 2018/0014107 | A1 | 1/2018 | Razouane et al. |
| 2018/0014108 | A1 | 1/2018 | Dragicevic et al. |
| 2018/0014109 | A1 | 1/2018 | Boesen |
| 2018/0014113 | A1 | 1/2018 | Boesen |
| 2018/0014140 | A1 | 1/2018 | Milevski et al. |
| 2018/0014436 | A1 | 1/2018 | Milevski |
| 2018/0034951 | A1 | 2/2018 | Boesen |
| 2018/0040093 | A1 | 2/2018 | Boesen |

FOREIGN PATENT DOCUMENTS

| | | | |
|---|---|---|---|
| CN | 104837094 | A | 8/2015 |
| EP | 1469659 | A1 | 10/2004 |
| EP | 1017252 | A3 | 5/2006 |
| EP | 2903186 | A1 | 8/2015 |
| GB | 2074817 | | 4/1981 |
| GB | 2508226 | A | 5/2014 |
| JP | 06292195 | | 10/1998 |
| WO | 2008103925 | A1 | 8/2008 |
| WO | 2008113053 | A1 | 9/2008 |
| WO | 2007034371 | A3 | 11/2008 |
| WO | 2011001433 | A2 | 1/2011 |
| WO | 2012071127 | A1 | 5/2012 |
| WO | 2013134956 | A1 | 9/2013 |
| WO | 2014046602 | A1 | 3/2014 |
| WO | 2014043179 | A3 | 7/2014 |
| WO | 2015061633 | A2 | 4/2015 |
| WO | 2015110577 | A1 | 7/2015 |
| WO | 2015110587 | A1 | 7/2015 |
| WO | 2016032990 | A1 | 3/2016 |
| WO | 2016187869 | A1 | 12/2016 |

OTHER PUBLICATIONS

Update From BRAGI—$3,000,000—Yipee (Mar. 22, 2014).
Wertzner et al., "Analysis of fundamental frequency, jitter, shimmer and vocal intensity in children with phonological disorders", V. 71, n.5, 582-588, Sep./Oct. 2005; Brazilian Journal of Othrhinolaryngology.
Wikipedia, "Gamebook", https://en.wikipedia.org/wiki/Gamebook, Sep. 3, 2017, 5 pages.
Wikipedia, "Kinect", "https://en.wikipedia.org/wiki/Kinect", 18 pages, (Sep. 9, 2017).
Wikipedia, "Wii Balance Board", "https://en.wikipedia.org/wiki/Wii_Balance_Board", 3 pages, (Jul. 20, 2017).
Akkermans, "Acoustic Ear Recognition for Person Identification", Automatic Identification Advanced Technologies, 2005 pp. 219-223.
Alzahrani et al: "A Multi-Channel Opto-Electronic Sensor to Accurately Monitor Heart Rate against Motion Artefact during Exercise", Sensors, vol. 15, No. 10, Oct. 12, 2015, pp. 25681-25702, XP055334602, DOI: 10.3390/s151025681 the whole document.
Announcing the $3,333,333 Stretch Goal (Feb. 24, 2014).
Ben Coxworth: "Graphene-based ink could enable low-cost, foldable electronics", "Journal of Physical Chemistry Letters", Northwestern University, (May 22, 2013).
Blain: "World's first graphene speaker already superior to Sennheiser MX400", htt://www.gizmag.com/graphene-speaker-beats-sennheiser-mx400/31660, (Apr. 15, 2014).
BMW, "BMW introduces BMW Connected—The personalized digital assistant", "http://bmwblog.com/2016/01/05/bmw-introduces-bmw-connected-the-personalized-digital-assistant", (Jan. 5, 2016).
BRAGI is on Facebook (2014).
BRAGI Update—Arrival of Prototype Chassis Parts—More People—Awesomeness (May 13, 2014).
BRAGI Update—Chinese New Year, Design Verification, Charging Case, More People, Timeline(Mar. 6, 2015).
BRAGI Update—First Sleeves From Prototype Tool—Software Development Kit (Jun. 5, 2014).
BRAGI Update—Let's Get Ready to Rumble, A Lot to Be Done Over Christmas (Dec. 22, 2014).
BRAGI Update—Memories From April—Update on Progress (Sep. 16, 2014).
BRAGI Update—Memories from May—Update on Progress—Sweet (Oct. 13, 2014).
BRAGI Update—Memories From One Month Before Kickstarter—Update on Progress (Jul. 10, 2014).
BRAGI Update—Memories From the First Month of Kickstarter—Update on Progress (Aug. 1, 2014).
BRAGI Update—Memories From the Second Month of Kickstarter—Update on Progress (Aug. 22, 2014).
BRAGI Update—New People @BRAGI—Prototypes (Jun. 26, 2014).
BRAGI Update—Office Tour, Tour to China, Tour to CES (Dec. 11, 2014).
BRAGI Update—Status on Wireless, Bits and Pieces, Testing-Oh Yeah, Timeline(Apr. 24, 2015).
BRAGI Update—The App Preview, The Charger, The SDK, BRAGI Funding and Chinese New Year (Feb. 11, 2015).
BRAGI Update—What We Did Over Christmas, Las Vegas & CES (Jan. 19, 2014).
BRAGI Update—Years of Development, Moments of Utter Joy and Finishing What We Started(Jun. 5, 2015).
BRAGI Update—Alpha 5 and Back to China, Backer Day, On Track(May 16, 2015).
BRAGI Update—Beta2 Production and Factory Line(Aug. 20, 2015).
BRAGI Update—Certifications, Production, Ramping Up.
BRAGI Update—Developer Units Shipping and Status(Oct. 5, 2015).
BRAGI Update—Developer Units Started Shipping and Status (Oct. 19, 2015).
BRAGI Update—Developer Units, Investment, Story and Status(Nov. 2, 2015).
BRAGI Update—Getting Close(Aug. 6, 2015).
BRAGI Update—On Track, Design Verification, How It Works and What's Next(Jul. 15, 2015).
BRAGI Update—On Track, On Track and Gems Overview.
BRAGI Update—Status on Wireless, Supply, Timeline and Open House@BRAGI(Apr. 1, 2015).
BRAGI Update—Unpacking Video, Reviews on Audio Perform and Boy Are We Getting Close(Sep. 10, 2015).

(56) References Cited

OTHER PUBLICATIONS

Healthcare Risk Management Review, "Nuance updates computer-assisted physician documentation solution" (Oct. 20, 2016).
Hoffman, "How to Use Android Beam to Wirelessly Transfer Content Between Devices", (Feb. 22, 2013).
Hoyt et. al., "Lessons Learned from Implementation of Voice Recognition for Documentation in the Military Electronic Health Record System", The American Health Information Management Association (2017).
Hyundai Motor America, "Hyundai Motor Company Introduces A Health + Mobility Concept for Wellness in Mobility", Fountain Valley, Californa (2017).
International Search Report & Written Opinion, PCT/EP16/70245 (dated Nov. 16, 2016).
International Search Report & Written Opinion, PCT/EP2016/070231 (dated Nov. 18, 2016).
International Search Report & Written Opinion, PCT/EP2016/070247 (dated Nov. 18, 2016).
Jain A et al: "Score normalization in multimodal biometric systems", Pattern Recognition, Elsevier, GB, vol. 38, No. 12, Dec. 31, 2005, pp. 2270-2285, XPO27610849, ISSN: 0031-3203.
Last Push Before the Kickstarter Campaign Ends on Monday 4pm CET (Mar. 28, 2014).
Nemanja Paunovic et al, "A methodology for testing complex professional electronic systems", Serbian Journal of Electrical Engineering, vol. 9, No. 1, Feb. 1, 2012, pp. 71-80, XPO55317584, Yu.
Nigel Whitfield: "Fake tape detectors, 'from the stands' footie and UGH? Internet of Things in my set-top box"; http://www.theregister.co.uk/2014/09/24/ibc_round_up_object_audio_dlna_iot/ (Sep. 24, 2014).
Nuance, "ING Netherlands Launches Voice Biometrics Payment System in the Mobile Banking App Powered by Nuance", "https://www.nuance.com/about-us/newsroom/press-releases/ing-netherlands-launches-nuance-voice-biometirics.html", 4 pages (Jul. 28, 2015).
Staab, Wayne J., et al., "A One-Size Disposable Hearing Aid is Introduced", The Hearing Journal 53(4):36-41) Apr. 2000.
Stretchgoal—It's Your Dash (Feb. 14, 2014).
Stretchgoal—The Carrying Case for The Dash (Feb. 12, 2014).
Stretchgoal—Windows Phone Support (Feb. 17, 2014).
The Dash + The Charging Case & The BRAGI News (Feb. 21, 2014).

* cited by examiner

AMBIENT ENVIRONMENTAL SOUND FIELD MANIPULATION BASED ON USER DEFINED VOICE AND AUDIO RECOGNITION PATTERN ANALYSIS SYSTEM AND METHOD

PRIORITY STATEMENT

This application claims priority to U.S. Provisional Patent Application No. 62/439,371, filed on Dec. 27, 2016, titled Ambient Environmental Sound Field Manipulation Based on User Defined Voice and Audio Recognition Pattern Analysis System and Method, all of which is hereby incorporated by reference in its entirety.

FIELD OF THE INVENTION

The present invention relates to wearable devices. Particularly, the present invention relates to earpieces. More particularly, but not exclusively, the present invention relates to wireless earpieces.

BACKGROUND

Users who wear earpieces may encounter many different environments running, jogging, or otherwise traveling during a given time period. On a daily basis people are subjected to a variety of noises of varying amplitude. These sources of noise affect a person's quality of life in a number of ways ranging from simple annoyance to noise induced fatigue and even hearing loss. Common sources of noise include those related to travel, e.g., subway trains, motorcycles, aircraft engine and wind noise, etc., and those related to one's occupation, e.g., factory equipment, chain saws, pneumatic drills, lawn mowers, hedgers, etc.

To help alleviate background noise while providing a source of entertainment, many people listen to music or other audio programming via a set of earpieces. Unfortunately, the use of earpieces may also lead to problematic, even dangerous situations if the user is unable to hear the various auditory cues and warnings commonly relied upon in day to day living (e.g., warning announcements, sirens, alarms, car horns, barking dogs, etc.). Accordingly, what is needed is a system provides its users with the benefits associated with headphones without their inherent drawbacks and limitations. Further, depending on the circumstances, a user may wish to modify how certain types of ambient sounds are heard depending on the user's location or preferences. What is needed is a system and method of ambient environmental sound field manipulation based on user defined voice and audio recognition pattern analysis.

SUMMARY

Therefore, it is a primary object, feature, or advantage of the present invention to improve over the state of the art.

In embodiments of the present invention an earpiece may have one or more of the following features: (a) an earpiece housing, (b) a first microphone operably coupled to the earpiece housing, (c) a speaker operably coupled to the earpiece housing, (d) a processor operably coupled to the earpiece housing, the first microphone, and the speaker, wherein the first microphone is positioned to receive an ambient sound, wherein the processor is programmed to characterize an environment associated with the ambient sound, and wherein the processor is programmed to modify the ambient sound based on a set of parameters associated with the environment, and (e) a second microphone operably coupled to the earpiece housing and the processor, wherein the second microphone is positioned to receive the ambient sound.

In embodiments of the present invention a set of earpieces comprising a left earpiece and a right earpiece, wherein each earpiece may have one or more of the following features: (a) an earpiece housing, (b) a microphone operably coupled to the earpiece housing, (c) a speaker operably coupled to the earpiece housing, and (d) a processor operably coupled to the earpiece housing, the microphone, and the speaker, wherein each microphone is positioned to receive an ambient sound, wherein each processor is programmed to characterize an environment associated with the ambient sound, wherein each processor is programmed to modify the ambient sound based on a set of parameters associated with the environment.

In embodiments of the present invention, a method of modifying ambient sound received by an earpiece in accordance with an environmental characterization may have one or more of the following steps: (a) receiving the ambient sound at a microphone operably coupled to the earpiece, (b) determining, via a processor operably coupled to the microphone, the environmental characterization based on the ambient sound, (c) modifying, via the processor, the ambient sound in accordance with a plurality of parameters associated with the environmental characterization to create a modified ambient sound, (d) communicating, via a speaker operably coupled to the earpiece, the modified ambient sound, (e) receiving the ambient sound at the second microphone, (f) determining, via the processor, a location of the ambient sound from a temporal differential and an intensity differential between the reception of the ambient sound at the microphone and the reception of the ambient sound at the second microphone, and (g) determining, via the processor, a location of the ambient sound from a temporal differential and an intensity differential between the reception of the ambient sound at the microphone of the earpiece and the reception of the ambient sound at the second microphone of the second earpiece.

One or more of these and/or other objects, features, or advantages of the present invention will become apparent from the specification and claims follow. No single embodiment need provide each and every object, feature, or advantage. Different embodiments may have different objects, features, or advantages. Therefore, the present invention is not to be limited to or by an object, feature, or advantage stated herein.

DETAILED DESCRIPTION

Figure 1:
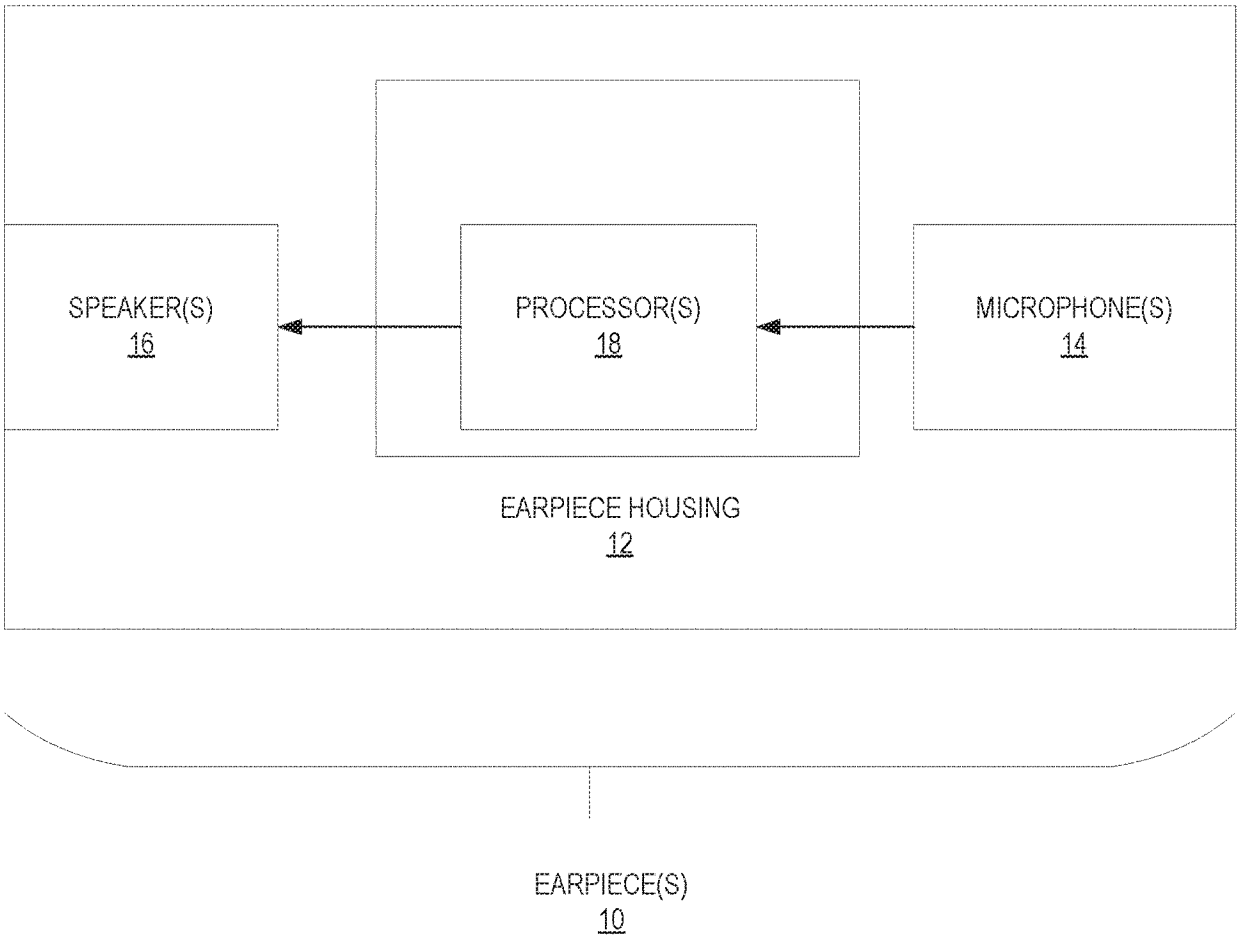
FIG. 1 illustrates a block diagram of an earpiece in accordance with an embodiment of the present invention.

The following discussion is presented to enable a person skilled in the art to make and use the present teachings. Various modifications to the illustrated embodiments will be readily apparent to those skilled in the art, and the generic principles herein may be applied to other embodiments and applications without departing from the present teachings. Thus, the present teachings are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the present teachings. Skilled artisans will recognize the examples provided herein have many useful alternatives and fall within the scope of the present teachings. While embodiments of the present invention are discussed in terms of earpieces controlling and/or modifying ambient sound, it is fully contemplated embodiments of the present invention could be used in most any electronic communications device without departing from the spirit of the invention.

It is an object, feature, or advantage of the present invention to characterize an environment associated with an ambient sound.

It is a still further object, feature, or advantage of the present invention to modify an ambient sound based on the environment the ambient sound originates.

Another object, feature, or advantage is to modify an ambient sound based on parameters associated with the environment.

Yet another object, feature, or advantage is to modify an ambient sound based on one or more user settings.

Yet another object, feature, or advantage is to automatically modify an ambient sound based on user or third party histories or preferences.

In one embodiment, an earpiece includes an earpiece housing, a microphone operably coupled to the earpiece housing, a speaker operably coupled to the earpiece housing, and a processor operably coupled to the earpiece housing, the microphone, and the speaker. The microphone is positioned to receive an ambient sound. The processor is programmed to both characterize an environment associated with the ambient sound and modify the ambient sound based on a set of parameters associated with the environment.

One or more of the following features may be included. The parameters associated with the environment may be based on user settings. The user settings may be made via voice input. A second microphone may be operably coupled to the earpiece housing and the processor and may be positioned to receive the ambient sound. The processor may determine a location of the ambient sound from a temporal differential between the reception of the ambient sound at the microphone and the reception of the ambient sound at the second microphone. The modification of the ambient sound may be automatically performed based on the set of parameters associated with the environment.

In another embodiment, a set of earpieces having a left earpiece and a right earpiece each include an earpiece housing, a microphone operably coupled to the earpiece housing, a speaker operably coupled to the earpiece housing, and a processor operably coupled to the earpiece housing, the microphone, and the speaker. The microphone is positioned to receive an ambient sound. The processor is programmed to both characterize an environment associated with the ambient sound and modify the ambient sound based on a set of parameters associated with the environment.

One or more of the following features may be included. The parameters associated with the environment may be based on user settings. The user settings may be made via voice input. The processor may determine a location of the ambient sound from a temporal differential between the reception of the ambient sound at the microphone of the left earpiece and the reception of the ambient sound at the microphone of the right earpiece. The modification of the ambient sound may be automatically performed based on the set of parameters associated with the environment.

In another embodiment, a method of modifying an ambient sound received by an earpiece in accordance with an environmental characterization includes receiving the ambient sound at a microphone operably coupled to the earpiece, determining the environmental characterization based on the ambient sound using a processor operably coupled to the earpiece, modifying the ambient sound in accordance with a plurality of parameters associated with the environmental characterization to create a modified ambient sound using the processor operably coupled to the earpiece, and communicating the modified ambient sound using a speaker operably coupled to the earpiece.

One or more of the following features may be included. The parameters associated with the environmental characterization may be based on user settings. The user settings may be made via voice input. The user settings may include location data, user history, user preferences, third party history or third party preferences. The earpiece may further include a second microphone. The ambient sound may be received at the second microphone. The processor may determine a location of the ambient sound from a temporal differential and an intensity differential between the reception of the ambient sound at the microphone and the reception of the ambient sound at the second microphone. The ambient sound may be received by a second earpiece having a second microphone. The processor may determine a location of the ambient sound from a temporal differential and an intensity differential between the reception of the ambient sound at the microphone of the earpiece and the reception of the ambient sound at the second microphone of the second earpiece.

FIG. 1 illustrates a block diagram of an earpiece 10 having an earpiece housing 12, a microphone 14 operably coupled to the earpiece housing 12, a speaker 16 operably coupled to the earpiece housing 12, and a processor 18 operably coupled to the earpiece housing 12, the microphone 14, and the speaker 16. The microphone 14 is positioned to receive an ambient sound and the processor 18 is programmed to characterize an environment associated with the ambient sound and modify the ambient sound based on a set of parameters associated with the environment. Each of the aforementioned components may be arranged in any manner suitable to implement the earpiece 10.

The earpiece housing 12 may be composed of plastic, metallic, nonmetallic, or any material or combination of materials having substantial deformation resistance in order to facilitate energy transfer if a sudden force is applied to the earpiece 10. For example, if the earpiece 10 is dropped by a user, the earpiece housing 12 may transfer the energy received from the surface impact throughout the entire earpiece. In addition, the earpiece housing 12 may be capable of a degree of flexibility in order to facilitate energy absorbance if one or more forces is applied to the earpiece 10. For example, if an object is dropped on the earpiece 12, the earpiece housing 12 may bend in order to absorb the energy from the impact so the components within the earpiece 10 are not substantially damaged. The flexibility of the earpiece housing 12 should not, however, be flexible to the point where one or more components of the earpiece 10 may become dislodged or otherwise rendered non-functional if one or more forces is applied to the earpiece 10.

A microphone 14 is operably coupled to the earpiece housing 12 and the processor 18 and is positioned to receive ambient sounds. The ambient sounds may originate from an object worn or carried by a user, a third party, or the environment. Environmental sounds may include natural sounds such as thunder, rain, or wind or artificial sounds such as sounds made by machinery at a construction site. The type of microphone 14 employed may be a directional, bidirectional, omnidirectional, cardioid, shotgun, or one or more combinations of microphone types, and more than one microphone may be present in the earpiece 10. If more than one microphone is employed, each microphone 14 may be arranged in any configuration conducive to receiving an ambient sound. In addition, each microphone 14 may comprise an amplifier and/or an attenuator configured to modify sounds by either a fixed factor or in accordance with one or more user settings of an algorithm stored within a memory or the processor 18 of the earpiece 10. For example, a user may issue a voice command to the earpiece 10 via the microphone 14 to instruct the earpiece 10 to amplify sounds having sound profiles substantially similar to a human voice and attenuate sounds exceeding a certain sound intensity. The user may also modify the user settings of the earpiece 10 using a voice command received by one of the microphones 14, a control panel or gestural interface on the earpiece 10, or a software application stored on an external electronic device such as a mobile phone or a tablet capable of interfacing with the earpiece 10. Sounds may also be amplified or attenuated by an amplifier or an attenuator operably coupled to the earpiece 10 and separate from the microphones 14 before being communicated to the processor 18 for sound processing.

A speaker 16 is operably coupled to the earpiece housing 12 and the processor 18. The speaker 16 may produce ambient sounds modified by the processor 18 or one or more additional components of the earpiece 10. The modified ambient sounds produced by the speaker 16 may include modified sounds made by an object worn or carried by the user, one or more amplified human voices, one or more attenuated human voices, one or more amplified environmental sounds, one or more attenuated environmental sounds, or a combination of one or more of the aforementioned modified sounds. In addition, the speaker 16 may produce additional sounds such as music or a sporting event either stored within a memory of the earpiece 10 or received from a third party electronic device such as a mobile phone, tablet, communications tower, or a WiFi hotspot in accordance with one or more user settings. For example, the speaker 16 may communicate music communicated from a radio tower of a radio station at a reduced volume in addition to communicating or producing certain artificial noises such as noises made by heavy machinery when in use. In addition, the speaker 16 may be positioned proximate to a temporal bone of the user in order to conduct sound for people with limited hearing capacity. More than one speaker 16 may be operably coupled to the earpiece housing 12 and the processor 18.

The processor 18 is operably coupled to the earpiece housing 12, the microphone 14, and the speaker 16 and is programmed to characterize an environment associated with the ambient sound. The characterization of the environment by the processor 18 may be performed using the ambient sounds received by the microphone 14. For example, the processor 18 may use a program or an algorithm stored in a memory or the processor 18 itself on the ambient sound to determine or approximate the environment in which jackhammer sounds, spoken phrases such as "Don't drill too deep!," or other types of machinery sounds originate, which in this case may be a construction site or a road repair site. In addition, the processor 18 may use sensor readings or information encoded in a signal received by a third party electronic device to assist in making the characterization of the environment. For example, in the previous example, the processor may use information encoded in a signal received from a mobile device using a third party program such as Waze to determine the ambient sounds come from a water main break is causing a severe traffic jam. In addition, the processor 18 is programmed to modify the ambient sound based on a set of parameters associated with the environment. The modification may be performed in accordance with one or more user settings. The user settings may include, for example, to amplify the sounds of speech patterns if the sound level of the origin of the sounds is low, to attenuate the sounds of machinery if the sounds exceed a certain decibel level, to remove all echoes regardless of environment, or to filter out sounds having a profile similar to crowd noise when attending a live entertainment event. The set of parameters may also be based on one or more sensor readings, one or more sounds, or information encoded in a signal received by a transceiver.

Figure 2:
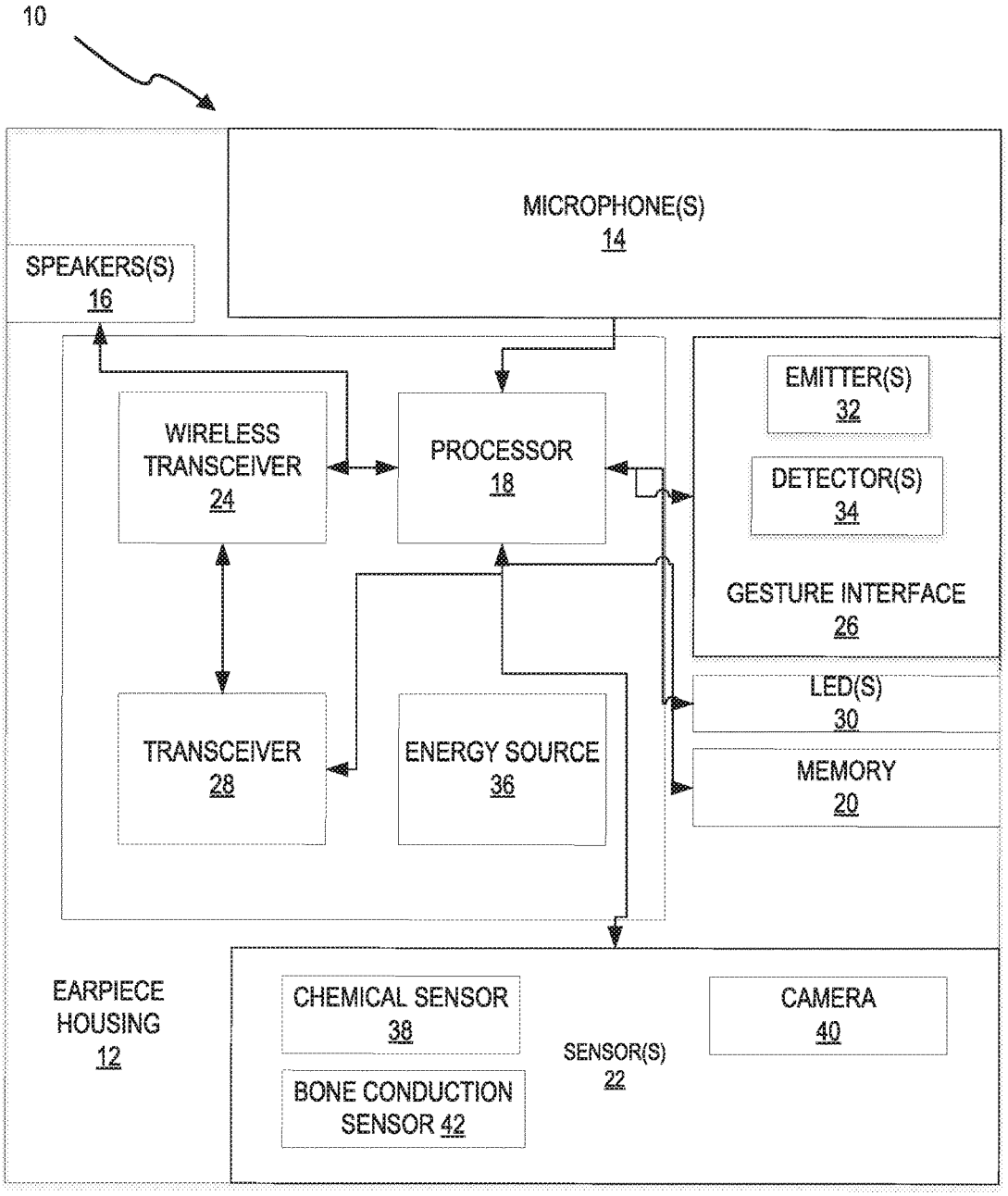
FIG. 2 illustrates a block diagram of an earpice in accordance with an embodiment of the present invention.

FIG. 2 illustrates another embodiment of the earpiece 10. In addition to the elements described in FIG. 1 above, the earpiece 10 may further include a memory 20 operably coupled to the earpiece housing 12 and the processor 18, wherein the memory 20 stores various programs, applications, and algorithms used to characterize an environment associated with the ambient sound and modify the ambient sound, one or more sensors 22 operably coupled to the earpiece housing 12 and the processor 18, a wireless transceiver 24 disposed within the earpiece housing 12 and operably coupled to the processor 18, a gesture interface 26 operably coupled to the earpiece housing 12 and the processor 18, a transceiver 28 disposed within the earpiece housing 12 and operably coupled to the processor 18, one or more LEDs 30 operably coupled to the earpiece housing 12 and the processor 18, and an energy source 36 disposed within the earpiece housing 12 and operably coupled to each component within the earpiece 10. The earpiece housing 12, the microphone 14, the speaker 16, and the processor 18 all function substantially the same as described in FIG. 1, with differences in regards to the additional components as described below.

Memory 20 may be operably coupled to the earpiece housing 12 and the processor 18 and may have one or more programs, applications, or algorithms stored within may be used in characterizing an environment associated with an ambient sound or modifying the ambient sound based on a set of parameters associated with the environment utilizing environmental charachterization 100. For example, the memory 20 may have a program which compares sound profiles of ambient sounds received by the microphone 14 with one or more sound profiles of certain types of environments. If the sound profile of an ambient sound substantially matches one of the sound profiles in the memory 20 when the program is executed by the processor 18, then the processor 18 may determine an environment is successfully characterized with the ambient sound. In addition, the memory 20 may have one or more programs or algorithms to modify the ambient sound in accordance with a set of parameters associated with the environment. For example, if the user desires the converse with someone while wearing an earpiece, then the processor 18 may execute a program or application stored on the memory 20 to attenuate or eliminate all ambient sounds not substantially matching a sound profile similar to the sound of a human voice. The memory 20 may also have other programs, applications, or algorithms stored within are not related to characterizing an environment or modifying an ambient sound.

The memory 20 is a hardware component, device, or recording media configured to store data for subsequent retrieval or access at a later time. The memory 20 may be static or dynamic memory. The memory 20 may include a hard disk, random access memory, cache, removable media drive, mass storage, or configuration suitable as storage for data, instructions and information. In one embodiment, the memory 20 and the processor 18 may be integrated. The memory 18 may use any type of volatile or non-volatile storage techniques and mediums. The memory 18 may store information related to the status of a user and other peripherals, such as a mobile phone 60 and so forth. In one embodiment, the memory 20 may display instructions or programs for controlling the gesture control interface 26 including one or more LEDs or other light emitting components 32, speakers 16, tactile generators (e.g., vibrator) and so forth. The memory 20 may also store the user input information associated with each command. The memory 20 may also store default, historical or user specified information regarding settings, configuration or performance of the earpieces 10 (and components thereof) based on the user contact with contacts sensor(s) 22 and/or gesture control interface 26.

The memory 20 may store settings and profiles associated with users, speaker settings (e.g., position, orientation, amplitude, frequency responses, etc.) and other information and data may be utilized to operate the earpieces 10. The earpieces 10 may also utilize biometric information to identify the user so settings and profiles may be associated with the user. In one embodiment, the memory 20 may include a database of applicable information and settings. In one embodiment, applicable gesture information received from the gesture interface 26 may be looked up from the memory 20 to automatically implement associated settings and profiles.

One or more sensors 22 may be operably coupled to the earpiece housing 12 and the processor 18 and may be positioned or configured to sense various external stimuli used to better characterize an environment. One or more sensors 22 may include a chemical sensor 38, a camera 40 or a bone conduction sensor 42. For example, if the microphone 14 picks up ambient sounds consisting of a blazing fire but a chemical sensor 38 does not sense any smoke, this information may be used by the processor 18 to determine the user is not actually near a blazing fire, but may be in a room watching a television program currently showing a blazing fire. In addition, an image or video captured by a camera 40 may be employed to better ascertain an environment associated with an ambient sound. A bone conduction sensor 42 may also be used to ascertain whether a sound originates from the environment or the user. For example, in order to differentiate whether a voice originates from a third party or the user, a timing difference between when the voice reaches the microphone 14 and when the voice reaches the bone conduction sensor 42 may be used by the processor 18 to determine the origin of the voice. Other types of sensors may be employed to improve the capabilities of the processor 18 in characterizing an environment associated with one or more ambient sounds.

Wireless transceiver 24 may be disposed within the earpiece housing 12 and operably coupled to the processor 18 and may receive signals from or transmit signals to another electronic device. The signals received by the wireless transceiver 24 may encode data or information related to a current environment or parameters associated with the environment. For example, the wireless transceiver 24 may receive a signal encoding information regarding the user's current location, which may be used by the processor 18 in better characterizing an environment. The information may come from a mobile device, a tablet, a communications tower such as a radio tower, a WiFi hotspot, or another type of electronic device. In addition, the wireless transceiver 24 may receive signals encoding information concerning how the user wants an ambient sound modified. For example, a user may use a program on a mobile device such as a smartphone 60 to instruct the earpiece 10 to attenuate a loud uncle's voice if the microphone 14 receives such a sound and transmit the instructions to the memory 20 or processor 18 of the earpiece 10 using the smartphone, which may be received by the wireless transceiver 24 before being received by the processor 18 or memory 20. The wireless transceiver 24 may also receive signals encoding data related to media or information concerning news, current events, or entertainment, information related to the health of a user or a third party, information regarding the location of a user or third party, or information concerning the functioning of the earpiece 10. More than one signal may be received from or transmitted by the wireless transceiver 24.

Gesture interface 26 may be operably coupled to the earpiece housing 12 and the processor 18 and may be configured to allow a user to control one or more functions of the earpiece 10. The gesture interface 26 may include at least one emitter 32 and at least one detector 34 to detect gestures from either the user, a third party, an instrument, or a combination of the aforementioned and communicate one or more signals representing the gesture to the processor 18. The gestures may be used with the gesture interface 26 to control the earpiece 10 including, without limitation, touching, tapping, swiping, use of an instrument, or any combination of the aforementioned gestures. Touching gestures used to control the earpiece 10 may be of any duration and may include the touching of areas not part of the gesture interface 26. Tapping gestures used to control the earpiece 10 may include any number of taps and need not be brief. Swiping gestures used to control the earpiece 10 may include a single swipe, a swipe changes direction at least once, a swipe with a time delay, a plurality of swipes, or any combination of the aforementioned. An instrument used to control the earpiece 10 may be electronic, biochemical or mechanical, and may interface with the gesture interface 26 either physically or electromagnetically.

Transceiver 28 may be disposed within the earpiece housing 12 and operably coupled to the processor 18 and may be configured to send or receive signals from another earpiece if the user is wearing an earpiece 10 in both ears. The transceiver 28 may receive or transmit more than one signal simultaneously. For example, a transceiver 28 in an earpiece 10 worn at a right ear may transmit a signal encoding instructions for modifying a certain ambient sound (e.g. thunder) to an earpiece 10 worn at a left ear while receiving a signal encoding instructions for modifying crowd noise from the earpiece 10 worn at the left ear. The transceiver 28 may be of any number of types including a near field magnetic induction (NFMI) transceiver.

LEDs 30 may be operably coupled to the earpiece housing 12 and the processor 18 and may be configured to provide information concerning the earpiece 10. For example, the processor 18 may communicate a signal encoding information related to the current time, the battery life of the earpiece 10, the status of another operation of the earpiece 10, or another earpiece function to the LEDs 30, which may subsequently decode and display the information encoded in the signals. For example, the processor 18 may communicate a signal encoding the status of the energy level of the earpiece, wherein the energy level may be decoded by LEDs 30 as a blinking light, wherein a green light may represent a substantial level of battery life, a yellow light may represent an intermediate level of battery life, a red light may represent a limited amount of battery life, and a blinking red light may represent a critical level of battery life requiring immediate recharging. In addition, the battery life may be represented by the LEDs 30 as a percentage of battery life remaining or may be represented by an energy bar having one or more LEDs, wherein the number of illuminated LEDs represents the amount of battery life remaining in the earpiece. The LEDs 30 may be located in any area on the earpiece 10 suitable for viewing by the user or a third party and may also consist of as few as one diode which may be provided in combination with a light guide. In addition, the LEDs 30 need not have a minimum luminescence.

Energy source 36 is operably coupled to all of the components within the earpiece 10. The energy source 36 may provide enough power to operate the earpiece 10 for a reasonable duration of time. The energy source 36 may be of any type suitable for powering earpiece 10. However, the energy source 36 need not be present in the earpiece 10. Alternative battery-less power sources, such as sensors configured to receive energy from radio waves (all of which are operably coupled to one or more earpieces 10) may be used to power the earpiece 10 in lieu of an energy source 36.

Figure 3:
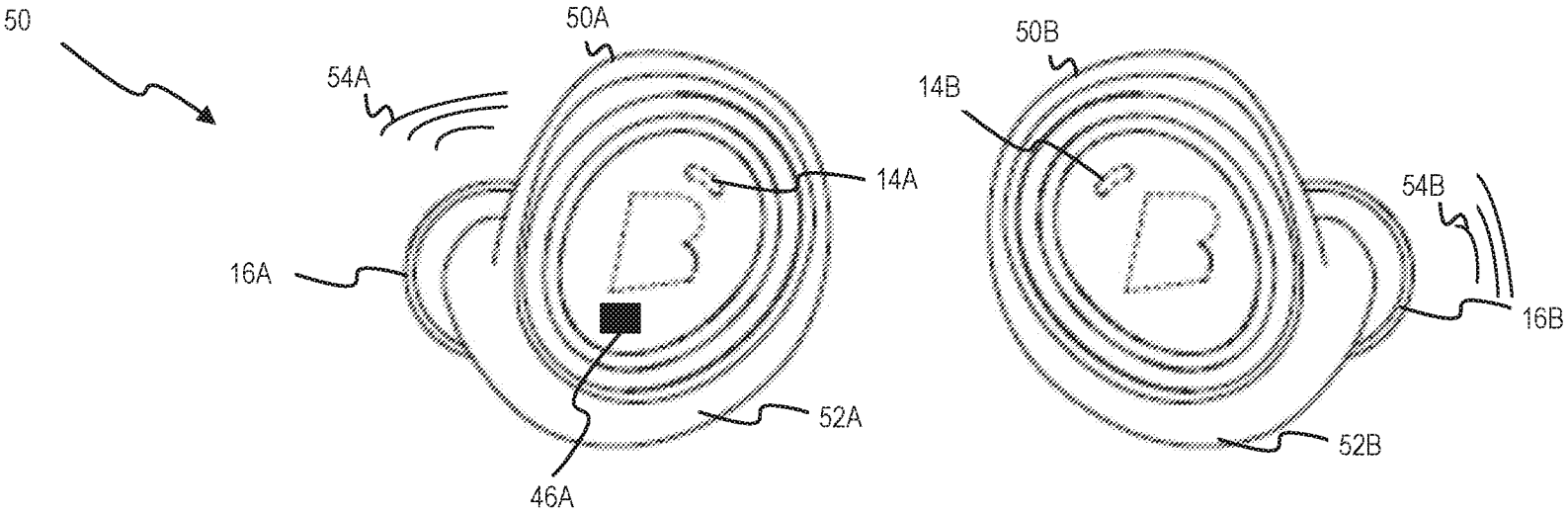
FIG. 3 illustrates a pictoraial representation of a set of earpieces in accordance with an embodiement of the present invention.

FIG. 3 illustrates a pair of earpieces 50 which includes a left earpiece 50A and a right earpiece 50B. The left earpiece 50A has a left earpiece housing 52A. The right earpiece 50B has a right earpiece housing 52B. The left earpiece 50A and the right earpiece 50B may be configured to fit on, at, or within a user's external auditory canal and may be configured to substantially minimize or completely eliminate external sound capable of reaching the tympanic membrane. The earpiece housings 52A and 52B may be composed of any material with substantial deformation resistance and may also be configured to be soundproof or waterproof. A microphone 14A is shown on the left earpiece 50A and a microphone 14B is shown on the right earpiece 50B. The microphones 14A and 14B may be located anywhere on the left earpiece 50A and the right earpiece 50B respectively and each microphone may be positioned to receive one or more ambient sounds from an object worn or carried by the user, one or more third parties, or the outside environment, whether natural or artificial. A second microphone 46A may also be included on an earpiece such as left earpiece 50A in order to ascertain a probable origin of an ambient sound when used in conjunction with microphone 14A. Speakers 16A and 16B may be configured to communicate modified ambient sounds 54A and 54B. The modified ambient sounds 54A and 54B may be communicated to the user, a third party, or another entity capable of receiving the communicated sounds. Speakers 16A and 16B may also be configured to short out if the decibel level of the processed sounds 54A and 54B exceeds a certain decibel threshold, which may be preset or programmed by the user or a third party.

Figure 4:
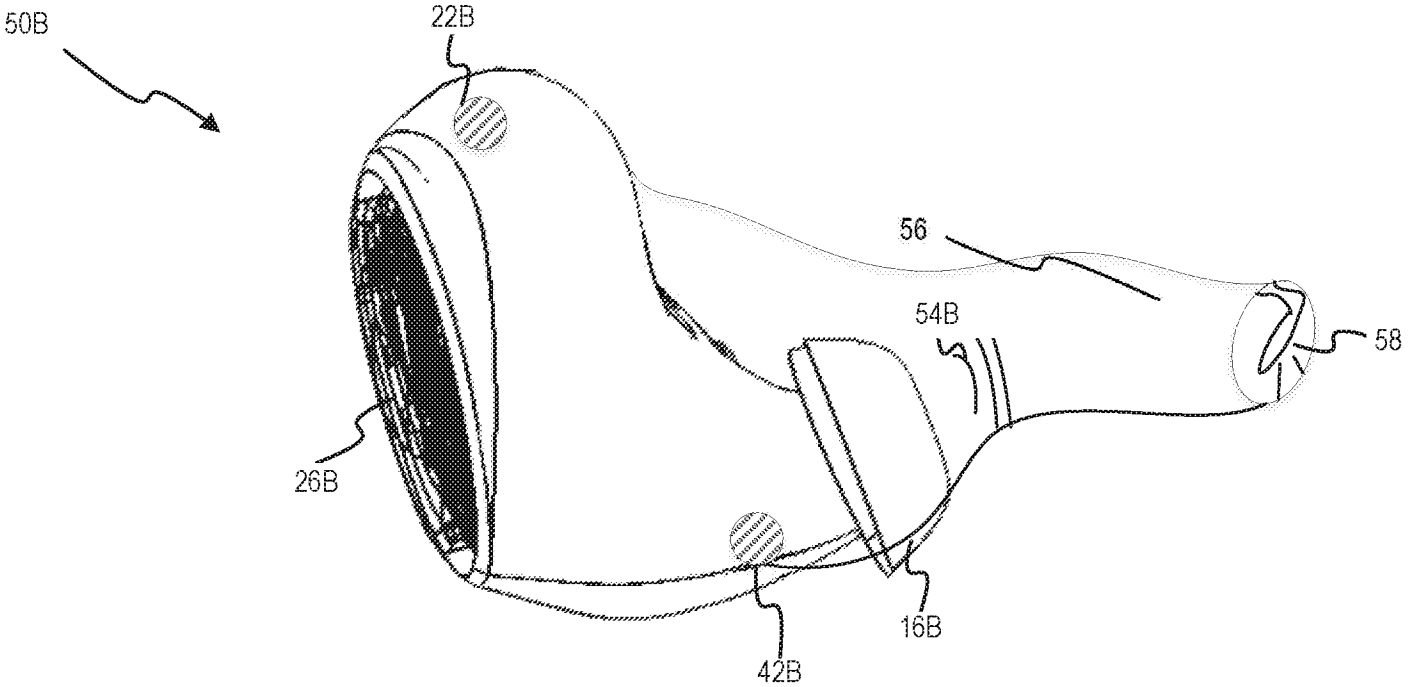
FIG. 4 illustrates a pictorial representation of a right earpiece and its relationship with a user's external auditory canal in accordance with an embodiment of the present inventon.

FIG. 4 illustrates a side view of the right earpiece 50B and its relationship to a user's ear. The right earpiece 50B may be configured to both minimize the amount of external sound reaching the user's external auditory canal 56 and to facilitate the transmission of the modified ambient sound 54B from the speaker 16B to a user's tympanic membrane 58. The right earpiece 50B may also be configured to be of any size necessary to comfortably fit within the user's external auditory canal 56 and the distance between the speaker 16B and the user's tympanic membrane 58 may be any distance sufficient to facilitate transmission of the modified ambient sound 54B to the user's tympanic membrane 58. A sensor 22B, which may include a chemical sensor 38 or a camera 40, may be placed on the right earpiece 50B and may be positioned to sense one or more pieces of data related to the environment. For example, the sensor 22B may be positioned on the right earpiece 50B to capture one or more images, detect the presence of one or more chemicals, or detect the presence of one or more additional environmental physical characteristics, all of which may be used to modify one or more ambient sounds received by the microphone 14B in conjunction with one or more parameters, which may include user settings or data contained in programs or algorithms stored in a memory operably coupled to the right earpiece 50B to modify or manipulate one or more ambient sounds for communication to the user's tympanic membrane 58. In addition, a bone conduction microphone 42B may be positioned near the temporal bone of the user's skull in order to sense a sound from a part of the user's body or to sense one or more sounds before the sounds reach one of the microphones 14 and/or 46 in order to determine if a sound is an ambient sound from the environment or if the sound originated from the user. The gesture interface 26B may provide for gesture control by the user or a third party such as by tapping or swiping across the gesture interface 26B, tapping or swiping across another portion of the right earpiece 50B, providing a gesture not involving the touching of the gesture interface 26B or another part of the right earpiece 50B, or through the use of an instrument configured to interact with the gesture interface 26B. The user may use the gesture interface 26B to set or modify one or more user settings to be used in conjunction with the modification of one or more ambient sounds.

Figure 5:
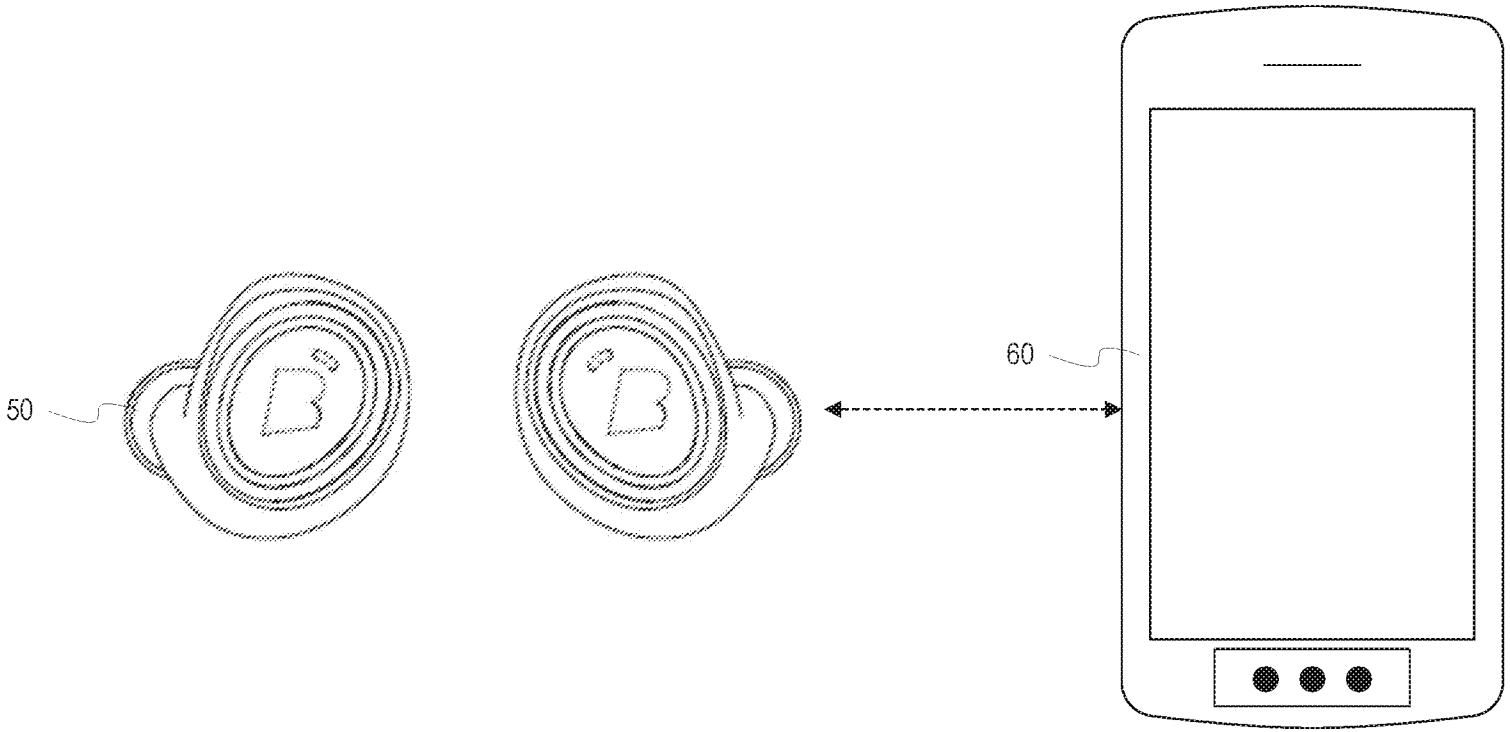
FIG. 5 illustrates a pictorial representation of a set of earpieces and its relationship with a mobile device in accordance with an embodiment of the present invention.

FIG. 5 illustrates a pair of earpieces 50 and their relationship to a mobile device 60. The mobile device 60 may be a mobile phone, a tablet, a watch, a PDA, a remote, an eyepiece, an earpiece, or any electronic device not requiring a fixed location. The user may use a software application on the mobile device 60 to set one or more user settings to be used to modify or manipulate one or more ambient sounds received by one of the earpieces. For example, the user may use a software application on the mobile device 60 to access a screen allowing the user to amplify low frequency sounds, filter high frequency sounds, attenuate crowd noise, or otherwise modify various types of ambient sounds. Sound profiles of various types of ambient sounds may be present on the mobile device 60 or may require downloading from an external electronic device. In addition, the user may use the mobile device 60 set the pair of earpieces 50 to automatically modify certain environmental sounds, such as echoes, when received by one or more of the microphones 14 and/or 46 of the pair of earpieces 50.

Figure 6:
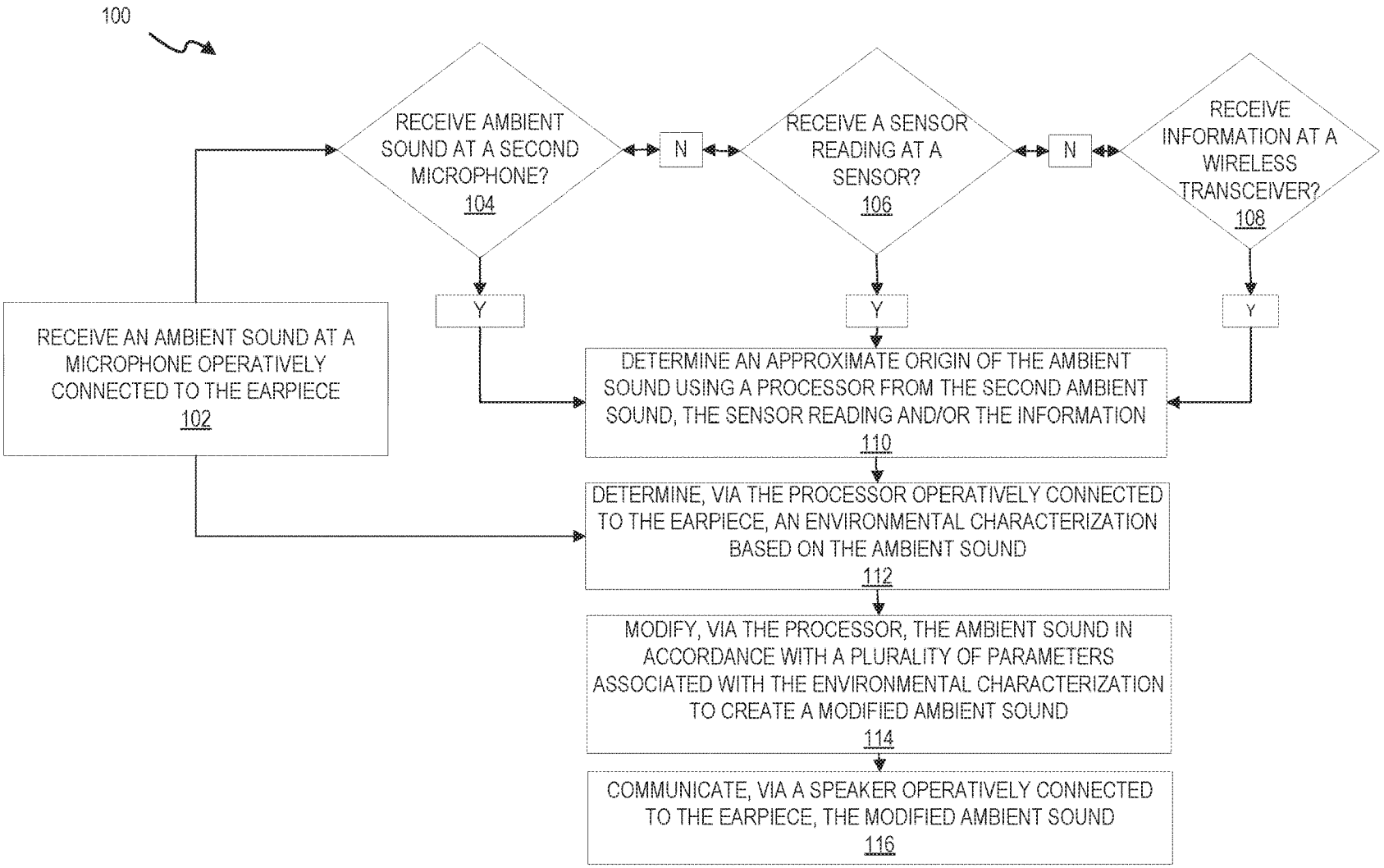
FIG. 6 illustrates a flowchart of a method of modifying an ambient sound received by an earpiece in accordance with an emdodiment of the present invention.

FIG. 6 illustrates a flowchart of a method of modifying an ambient sound received by an earpiece in accordance with an environmental characterization 100. First in step 102, an ambient sound is received by a microphone 14 operably coupled to the earpiece 50. The ambient sound may originate from an object worn or carried by the user, a third party, a natural environmental phenomenon such as thunder or rain or man-made objects such as machinery, and more than one ambient sound may be received by the microphone 14. In addition, the microphone 14 may receive one or more of the ambient sounds continuously or discretely depending on when the ambient sounds are created or communicated.

In step 104, the ambient sound may be received by a second microphone 46 operably coupled to the earpiece 50 or, if the user is wearing a pair of earpieces 50, the microphone 46 of the other earpiece 50. In step 106, if a sensor 22 is operably coupled to the earpiece 50, sensor readings may be received by the sensor 22 concerning the approximate origin of the ambient sound. Sensor readings may include images or video captured by a camera 40, gas concentration readings by a chemical sensor 38, or sounds captured by a bone conduction microphone 42. Other types of sensor reading may be used if they help in characterizing an environment.

In step 108, if a wireless transceiver 24 is operably coupled to the earpiece 50, then information concerning the approximate origin may be received by the wireless transceiver 24. This information may be received before, during, or after the creation or communication of the ambient sound, and information concerning the approximate origin of an ambient sound may be stored in a memory 20. If one or more ambient sounds is received by a second microphone 46, one or more sensor readings is received by a sensor 22, or information is received via the wireless transceiver 24, then in step 110, an approximate origin of the ambient sound may be determined. The approximate origin may be determined using an algorithm stored on a memory 20 or processor 18 within the earpiece 50, wherein the algorithm may determine the approximate origin using the temporal differences between when the ambient sound was received by each microphone 14 and 46, the differences in sound intensities between the sounds received by each microphone 14 and 46, the geometry of the user's physical features, the geometry and physical characteristics of each earpiece 50, potential differences in the waveform of the ambient sounds due to the angle the ambient sounds hitting the microphones 14 and 46, chemical readings captured by a sensor 38, images or videos captured by a camera 40, information from an external electronic device such as a mobile phone 60, a tablet, or a WiFi hotspot, or other physical parameters useful in ascertaining the approximate origin of the ambient sound.

Regardless of whether additional information was received by another component of the earpiece 50, in step 112, a processor 18 operably coupled to the earpiece 50 determines an environmental characterization based on the ambient sound. The determination of the environmental characterization may be performed using a program, application, or algorithm stored within a memory 20 operably coupled to the earpiece 50. The environmental characterization may be evident from the ambient sound itself or may require additional information. The additional information may come from a sensor reading, one or more images, data or information stored in a memory 20 or data or information encoded in a signal received by a transceiver 28 or wireless transceiver 24.

In step 114, the processor modifies the ambient sound in accordance with one or more parameters associated with the environmental characterization to create a modified ambient sound 54. The parameters may be derived from the ambient sounds themselves (e.g. a third party stipulating a crowd may be loud), sensor readings (e.g. images sensed by a sensor 22 and processed by a processor 18 may show an area is a crowded stadium), or information stored in a memory 20 or received from a mobile device 60 (e.g. user settings stipulating to attenuate mechanical noises when entering a construction site). The parameters may also be based on location data, user history, user preferences, one or more third party histories, or one or more third party preferences of the user. For example, if the user has repeatedly set sounds when in a grocery store to be amplified, the processor 18 may automatically apply the same settings when the user encounters a grocery store. Whether a user encounters a grocery store may be determined using a voice input, a sensor reading, or an analysis of ambient sounds originating in the location, which may suggest a grocery store. In step 116, the modified ambient sound is communicated via a speaker 16 operably coupled to the earpiece 50. The modified ambient sounds may be communicated as they are processed by the processor 18 or may be stored for later use.

The invention is not to be limited to the particular embodiments described herein. The foregoing description has been presented for purposes of illustration and description. It is not intended to be an exhaustive list or limit any of the invention to the precise forms disclosed. It is contemplated other alternatives or exemplary aspects are considered included in the invention. The description is merely examples of embodiments, processes or methods of the invention. It is understood any other modifications, substitutions, and/or additions can be made, which are within the intended spirit and scope of the invention.

What is claimed is:

1. An earpiece comprising:

an earpiece housing;

a first microphone operably coupled to the earpiece housing;

a second microphone operably coupled to the earpiece housing, wherein the second microphone is positioned to receive the ambient sound;

a sensor for detecting an environmental parameter to provide contextual information in addition to sound;

a speaker operably coupled to the earpiece housing; and a processor operably coupled to the earpiece housing, the first microphone, the second microphone, and the speaker, wherein the processor determines a location of the ambient sound from a temporal differential between the reception of the ambient sound at the first microphone and the reception of the ambient sound at the second microphone;

wherein the first microphone is positioned to receive an ambient sound;

wherein the processor is programmed to characterize an environment associated with the ambient sound using the ambient sound, sensor data for detecting the environment and user location data, user history, user preferences, and third party history or third-party preferences; and wherein the processor is programmed to modify the ambient sound based on a set of parameters associated with the environment and communicate, via the speaker, the modified ambient sound.

2. The earpiece of claim 1 wherein the parameters associated with the environment are based on user settings.

3. The earpiece of claim 2 wherein the user settings are made via voice input.

4. The earpiece of claim 1 wherein the modification of the ambient sound based on the set of parameters associated with the environment is performed automatically.

5. A set of earpieces comprising a left earpiece and a right earpiece, wherein each earpiece comprises:

an earpiece housing;

a microphone operably coupled to the earpiece housing;

a sensor for detecting an environmental parameter to provide contextual information in addition to sound;

a speaker operably coupled to the earpiece housing; and a processor operably coupled to the earpiece housing, the microphone, and the speaker, wherein the processor determines a location of the ambient sound from the reception of the ambient sound at the microphone of the left earpiece and the reception of the ambient sound at the microphone of the right earpiece; wherein each microphone is positioned to receive an ambient sound; wherein each processor is programmed to characterize an environment associated with the ambient sound using the ambient sound and sensor data for detecting the environment and user settings; and wherein each processor is programmed to modify the ambient sound based on a set of parameters associated with the environment and communicate, via the speaker, the modified ambient sound.

6. The set of earpieces of claim 5 wherein the parameters associated with the environment are based on the user settings.

7. The set of earpieces of claim 6 wherein the user settings are made via voice input.

8. The set of earpieces of claim 5 wherein the modification of the ambient sound based on the set of parameters associated with the environment is performed automatically.

9. A method of modifying ambient sound received by an earpiece in accordance with an environmental characterization comprising the steps of:

receiving the ambient sound at a first microphone and a second microphone operably coupled to the earpiece;

detecting an environmental parameter utilizing a sensor to provide contextual information in addition to sound;

determining, via a processor operably coupled to the microphones, the environmental characterization based on the ambient sound;

determining, via the processor, a location of the ambient sound from a temporal differential and an intensity differential between the reception of the ambient sound at the first microphone and the reception of the ambient sound at the second microphone;

characterizing an environment associated with the ambient sound using the ambient sound and the sensor data for detecting the environment and user settings;

modifying, via the processor, the ambient sound in accordance with a plurality of parameters associated with the environmental characterization to create a modified ambient sound; and communicating, via a speaker operably coupled to the earpiece, the modified ambient sound.

10. The method of claim 9 wherein the user settings are made via voice input.

11. The method of claim 10 wherein the user settings comprise location data, user history, user preferences, third party history, or third-party preferences.

12. The method of claim 9 wherein the earpiece further comprises a second microphone.

13. The method of claim 12 further comprising the step of receiving the ambient sound at the second microphone.

14. The method of claim 9 wherein the ambient sound is received by a second earpiece, wherein the second earpiece comprises a second microphone.

15. The method of claim 14 further comprising determining, via the processor, a location of the ambient sound from a temporal differential and an intensity differential between the reception of the ambient sound at the microphone of the earpiece and the reception of the ambient sound at the second microphone of the second earpiece.

* * * * *